United States Patent [19]

Gardner et al.

[11] Patent Number: 5,050,366

[45] Date of Patent: Sep. 24, 1991

[54] REINFORCED LAMINATED TIMBER

[76] Inventors: Guy P. Gardner, 14 Nansen Street, Northgate, Queensland 4013, Australia; Robert D. Eaton, 16 Emerald Street, Clontarf, Queensland, 4019, Australia

[21] Appl. No.: 453,122

[22] Filed: Dec. 4, 1989

[30] Foreign Application Priority Data

Nov. 11, 1987 [AU] Australia ..... PI5351

[51] Int. Cl.[5] ..... E04C 3/30

[52] U.S. Cl. ..... 52/730; 52/93; 52/736

[58] Field of Search ..... 428/537.1, 107, 106, 428/61; 238/37; 52/821, 690, 227, 93, 223 R, 720, 736, 730

[56] References Cited

U.S. PATENT DOCUMENTS

| | | | |
|---|---|---|---|
| 1,084,276 | 1/1914 | Jaminet | 52/821 |
| 3,166,873 | 1/1965 | Rosenfeld | 52/740 |
| 3,521,162 | 5/1966 | Strimple . | |
| 4,275,537 | 6/1981 | Pinson . | |
| 4,615,163 | 10/1986 | Curtis et al. . | |
| 4,965,973 | 10/1990 | Engebretsen | 52/642 |

FOREIGN PATENT DOCUMENTS

| | | | |
|---|---|---|---|
| 146861 | 3/1952 | Australia . | |
| 1392270 | 4/1970 | Australia . | |
| 444397 | 1/1974 | Australia . | |
| 3343384 | 8/1987 | Australia . | |
| 35365 | 6/1966 | Finland | 52/726 |
| 345754 | 7/1937 | Italy | 52/821 |
| 670732 | 7/1961 | Italy | 52/729 |
| 69345 | 12/1943 | Norway | 52/821 |
| 26010 | of 1911 | United Kingdom | 52/721 |

*Primary Examiner*—John E. Murtagh
*Attorney, Agent, or Firm*—Helfgott & Karas

[57] ABSTRACT

Composite structural timber which is reinforced with deformed metal bars. The timber comprises a plurality of wooden laminations bonded together by a resin adhesive. There are at least two longitudinally extending metal bars. One bar is located near one longitudinal edge of the timber and the other is located near the other longitudinal edge. The composite structure provides superior load carrying capacity and reduction in deflection under a given load. The main use is as structural timber beams and posts.

24 Claims, 4 Drawing Sheets

REINFORCED LAMINATED TIMBER

This is a continuation of application Ser. No. 271,159, filed Nov. 14, 1988, now abandoned.

This invention relates to composite structural members and is particularly concerned with laminated structural timber having reinforcing elements.

Laminated timber is widely used in residential and light engineering structures in situations where large beam depths are required, such as long span openings in houses. Large section timber is becoming more expensive and more difficult to obtain, and manufacturers have found it necessary to laminate smaller sections together to make the larger section sizes more readily available. Timber, in general, has a pleasing aesthetic effect and therefore in many architectural applications laminated beams are used, and are left exposed. However, bare timber is relatively weak both in strength and stiffness when compared with other building materials such as steel.

Laminating a number of smaller sections of timber together to make a larger member decreases the possibility of inherent weaknesses due to natural wood defects and also decreases the disparity in the strength of structural timber members because laminating effectively averages the varying properties of the timber used. But when joining shorter sections of timber together to make a single lamination, the joins themselves become a point of inherent weakness.

Disparity of strength still exists though, and therefore the structural members must be carefully graded, and any member having an apparent weakness, either due to natural wood defects or at the joins within the individual laminations, must be rejected or downgraded which, of course, decreases their commercial value substantially. Also the load carrying capacity of a timber member will, by the very nature of the material, vary due to such factors as humidity and temperature changes, degree of seasoning, moisture content, and load duration; and making allowances for these variations can downgrade the design loads and deflections of the member compared to a member which is not dependent on these factors.

A further weakness of timber when used as a structural member is the effect of timber relaxation when subjected to long duration loads. Most structural beams in house construction are designed for long duration load and because of timber relaxation, the stiffness of the beam is approximately halved.

Another disadvantage of timber as a structural member is its failure mode. When the ultimate load of the beam is reached, the extreme fibers of timber on the tension face split and then the beam can no longer sustain the applied load. The failure is a catastrophic collapse and therefore undesirable in construction.

Previous attempts to increase the strength and stiffness of structural timber members have been made. In U.S. Pat. No. 3251162 a series of rods or cables pass through a laminated beam and are connected to tensioning plates and bolts at either end. However, the manufacture of products where one or more elements must be held under tension is inherently expensive. It also prohibits cutting the member into smaller lengths.

In Australian Patent Specification No. 33,433/84, steel strips are connected to the outer faces of a timber member to increase the strength and stiffness. However, the external application of the reinforcing sections detract from the aesthetic appeal of the members and also cause difficulty in connecting the member. The method of bonding the strips to the timber has the adverse effect of severely damaging the extreme timber fibers which are crucial in transferring load into the strips and in taking load themselves.

U.S. Pat. No. 4,615,163 discloses a wooden beam reinforced with a glass fiber polyester rod. The rod is located within a groove formed on the surface of the beam or in a groove formed on the surface of a bottom lamination between adjacent laminations in a laminated beam. The rod is bound to the timber by a resin based adhesive. The disadvantage of these structures is that the bond between the rod and the timber is not particularly strong and the increase in strength which is obtained is so small as to not be economically viable. Furthermore, in the case of laminated beams, it is more economical to use additional laminations in the construction to gain the same increase in strength and stiffness, rather than use such reinforcements.

It is therefore an object of the present invention to provide a laminated structural timber member which is reinforced in such a way as to obviate or at least minimise the aforementioned disadvantages of known structural timber members.

According to one aspect of the present invention there is provided a laminated structural timber member comprising a plurality of longitudinally extending wooden laminations bonded together by a resin adhesive and reinforced by at least two longitudinally extending deformed metal bars, said deformed metal bars being bonded to one or more of the laminations by said resin adhesive, one at a location between the longitudinal axis of the timber member and a longitudinal edge of the timber member, and the other at a location between the longitudinal axis of the timber member and the other longitudinal edge of the timber member.

The use of metal bars for reinforcement significantly increases the strength characteristics of the laminated timber member and the deformations on the bars ensure that the metal bars are firmly keyed to the adhesive and to the wooden laminations.

The location of the metal bars within the timber member enables maximum load carrying capacity and reduction in deflection under a given load. The importance of the location of the metal bars can be demonstrated by reference to a 315 mm deep by 70 mm wide laminated timber beam of structural grade F22, with a 28 mm diameter high strength steel reinforcing bar placed at the center of the beam. The increase in the strength and stiffness of the beam is only 0.4%. Placing the bar close to the top or bottom of the beam increases the strength of the beam by approximately 23% and the stiffness by approximately 48%. However, placing 28 mm diameter bars both close to the top and bottom of the beam increases the strength and stiffness by a significant 128%. Placing two reinforcing bars at each the top and bottom, one on top of the other, increases the strength and stiffness by 192%. Two smaller bars side by side are only more effective) if the sum of their areas is greater than the 28 mm bar.

The term "deformed" in the expression "deformed metal bar" is intended to indicate a corrugated or rough textured surface, or a spiral type winding as is found on deformed steel reinforcement rods used in concrete reinforced structures.

The deformed metal bar may be fabricated from any metal suitable for the particular application to which the laminated timber member is to be put. Examples of suitable metals include aluminium, iron, steel, and various alloys. The most preferred metal is high strength reinforcement steel.

The deformed metal bar may have any profile or section which enables a keying effect to be produced between it and the resin adhesive. The preferred profile is that found on deformed steel reinforcing rods complying with the Australian Standard, Steel Reinforcing Bars for Concrete, AS1302 grade 410Y.

The maximum section of the deformed metal bar that can be used is dependent upon the shear stresses developed in the adjacent timber at the sides of the deformed metal bar. These shear stresses must comply with Australian Standard, Timber Engineering Code AS1720. Smaller sections still have significant increases in strength and stiffness and may therefore be used for economic or production reasons. The minimum section size that can be used is such that the increase in strength and stiffness is sufficient to economically justify its use. The maximum and minimum sizes of high strength deformed steel reinforcing bars produced are 36 mm diameter and 12 mm diameter respectively and are available in increments of 4 mm.

High strength deformed steel reinforcing bars are a preferred deformed bar because they have a deformation pattern that is used to physically key the bar in place within an adhesive and allows the transfer of load without needing or relying upon adhesive-steel adhesion. To ensure the physical keying of the deformations, the adhesive used should preferably be non-shrinking.

The deformed metal bars will generally extend over the entire length of the timber member for maximum effect. However, this is not essential since some applications may require lesser strength characteristics. It is, nevertheless, generally envisaged that the lower limit of extension will be approximately 10%. The preferred extension will lie within the range of 70% to 100% of the length of the timber member.

Preferably, the deformed metal bar reinforcements are located within planed, routed or milled grooves between laminations, close to the top and bottom longitudinal edges of the timber member.

The resin adhesive will typically be of the type commonly used in the manufacture of laminated beams; that is, one that complies with the Australian Standard, Glue Laminated Structural Timber Code, AS 1328, such as Epiglass Hi Tech HT 9000.

The timber member will generally be a beam, but it could also be a post, rafter, joist or like structural component which are all well known to the skilled addressee.

In a further aspect of the present invention, the aforementioned laminated structural timber member is adapted to enable attachment to other structural members, being either other laminated timber members or concrete or steel members. By "adapted" is meant one of the following: (i) that the deformed metal bar is restricted to such a length that a groove is left in one or both ends of the beam to enable a connecting rod to be inserted therein; (ii) that one or more additional grooves is formed in at least one end of the beam to enable one or more connecting rods to be inserted therein, or (iii) that at least one end of one or more of the reinforcing rods is routed around to enable attachment of the rod or rods to a mechanical coupler.

According to another aspect of the present invention, there is provided a method of making a laminated structural timber member of the aforementioned type, which method comprises the steps of:

(i) forming a longitudinal groove in one lamination element or two lamination elements which are adapted to be bonded together;
(ii) applying resin adhesive to the groove of one or both lamination elements;
(iii) placing a longitudinally extending deformed metal bar in the groove of one lamination element containing resin adhesive;
(iv) placing the other grooved lamination element, or a different non-grooved lamination element, over the lamination element containing the metal bar, either with or without the addition of further resin adhesive;
(v) adding further laminations, one or more of which are produced according to steps (i)–(iii) above; and
(vi) curing the resin adhesive.

The reinforced laminated structural timber member according to the present invention enables the timber member to increase its load carrying capacity and reduce its deflection under a given load, in a very economical manner.

The method of reinforcement overcomes inherent weaknesses resulting from either natural wood defects or joints between timber pieces within a lamination. It enables uniformity and reproducibility of end product. It reduces the effect of timber relaxation while subjected to long duration loads, i.e. to increase the long term stiffness of the timber.

When a deformed metal bar is located close to the top and bottom longitudinal edges of a structural timber element such as a beam, upon the beam reaching its ultimate capacity under an applied load and tensile cracks begin appearing in the timber fibers across the tension face of the beam, the deformed metal bars will themselves not be loaded to their ultimate capacity. This allows cracks, that is, areas of severe distress, to be observed prior to a catastrophic collapse.

Preferred embodiments of the invention will now be described with reference to the accompanying drawings, in which:

FIG. 1 illustrates a timber beam comprising a plurality of wooden laminations with a high strength deformed steel reinforcing rod 4 located in the lower and upper longitudinal sections of the beam adjacent to the edges thereof. An enlarged view of this rod is depicted in FIGS. 3 and 4.

The reinforcing rods 4 are located in grooves 3 that are milled, planed or routed in the timber to suit and accept the rods. The grooves are preferably positioned such that the timber thickness covering the reinforcing rod (refer FIG. 1 dimension "a") is approximately equal to the covering thickness to the sides of the beam (refer FIG. 1 dimension "b"). It is preferable that the grooves be as close fitting as possible to the size and shape of the reinforcing rod, and therefore, it is preferable to position the grooves 3 between laminations 2.

The reinforcing rods are fixed into the grooves with a resin-based adhesive 5 that complies with Australian Standards, Glue Laminated Structural Timber Code AS 1328, and therefore bonds to the surrounding timber such that the resulting bond is stronger in shear, tension and bearing than the timber.

Figure 1:
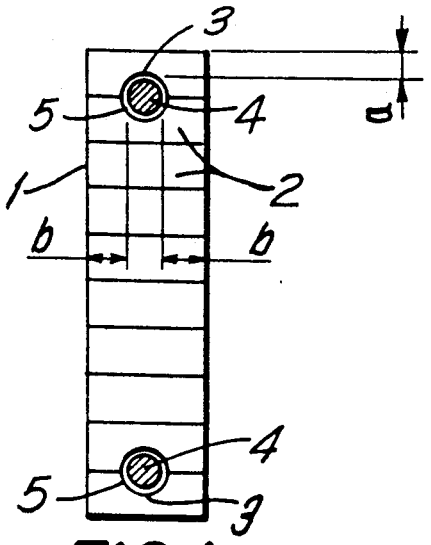
FIG. 1 is a sectional end view showing a laminated timber beam and the preferred positions and placement of the deformed reinforcing bars.

Table I summarises the increases in strength and stiffness using various preferred arrangements. The table shows the ranges of increase in strength and stiffness in percent, for beams reinforced with deformed steel reinforcing bars, placed in the outer laminations, as shown in FIG. 1, calculated over a range of beam widths and depths that are commercially available, and for differing timber structural grades.

TABLE I

| Steel Reinforcing Bar Diameters (mm) | 36 | 32 | 28 | 24 | 20 | 16 |
|---|---|---|---|---|---|---|
| Range of beam widths (mm) | 110–135 | 90–110 | 90–70 | 70–60 | 60–40 | 40 |
| Range of beam depths (mm) | 155–600 | 155–600 | 120–600 | 120–600 | 120–315 | 120–315 |
| TIMBER STRUCTURAL GRADE | | | | | | |
| F27 | 65–135 | 60–130 | 60–105 | 55–100 | 60–105 | 60–65 |
| F22 | 75–155 | 70–150 | 70–120 | 65–115 | 70–120 | 65–80 |
| F14 | 95–200 | 90–190 | 85–155 | 80–145 | 90–155 | 85–100 |
| F8 | 130–280 | 125–265 | 120–215 | 110–200 | 125–210 | 120–135 |

This table clearly demonstrates the substantial increase in strength obtained by reinforcing timber beams according to the present invention.

Figure 2:
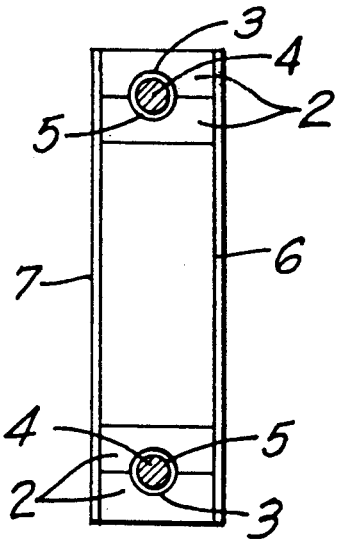
FIG. 2 is a sectional end view of a laminated timber box beam and the preferred positions and placement of the deformed reinforcing bars.
Figure 4:
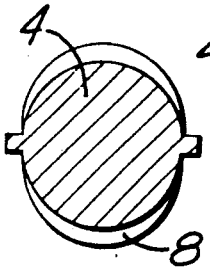
FIG. 4 is a cross-section of the rod depicted in FIG. 3.

Referring to FIG. 2, there is illustrated a laminated timber box beam 7 comprising timber laminations 2 along each longitudinal edge, thin plywood webs 6 formed along each face of the beam and deformed steel reinforcing rods 4 located in grooves 3 formed between the timber laminations 2.

Similar increases in strength and stiffness are exhibited by this structure as are exhibited by the structure described with reference to FIG. 1.

In beams reinforced in accordance with the above two embodiments, the reinforcing rods take a far greater proportion of the applied load than the timber in the beams. This means that the load carrying capacity of the member will vary significantly less due to atmospheric and timber property changes, which, of course, do not affect the reinforcing rods. This means that the occurrence of inherent weaknesses and the disparity of timber strength also have a much reduced effect on the member's strength.

Figure 5:
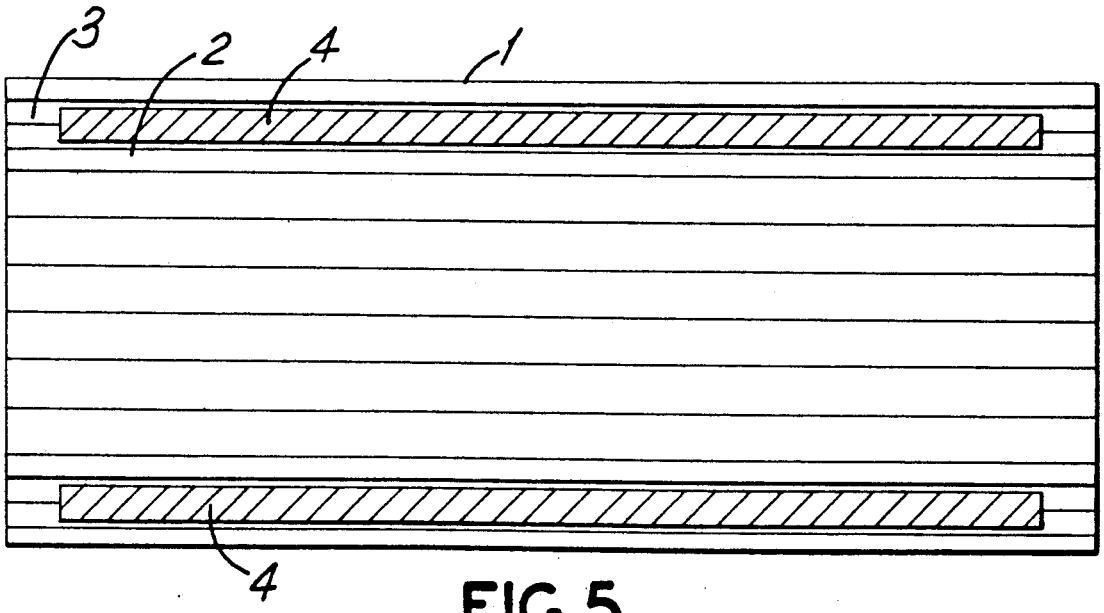
FIG. 5 is a sectional side view of a laminated timber beam as shown in FIG. 1.
Figure 6:
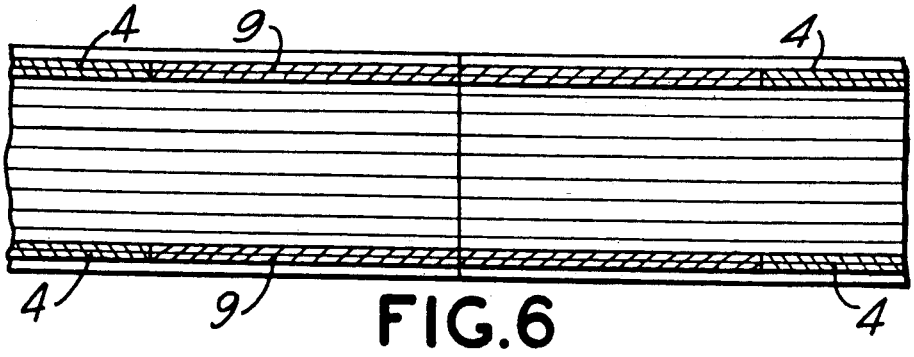
FIG. 6 is a sectional side view of a beam to beam pin splice using a dowelling technique.
Figure 7:
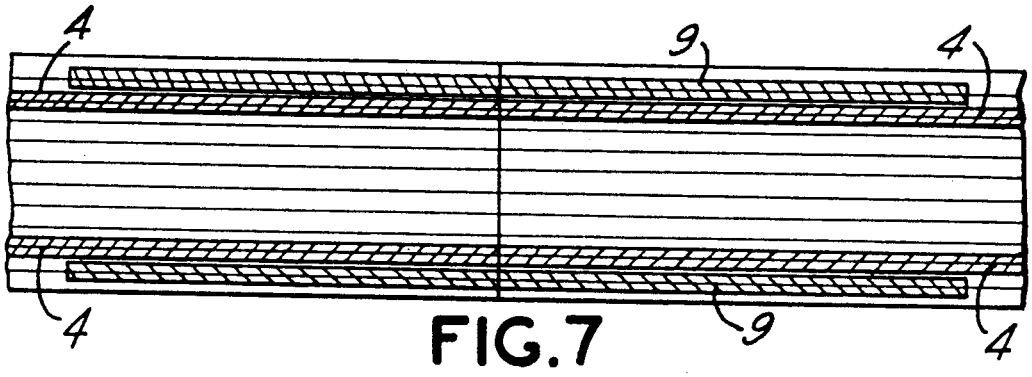
FIG. 7 is a sectional side view of a beam to beam moment splice using an overlap technique.
Figure 8:
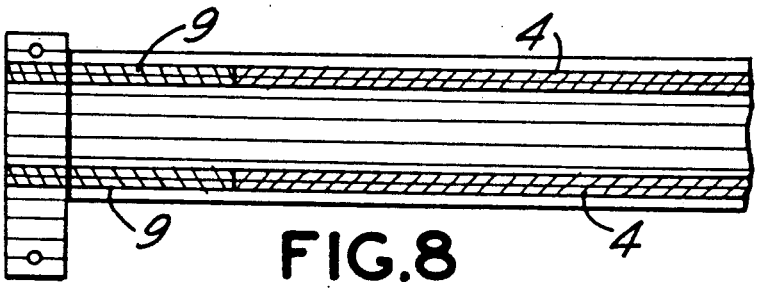
FIG. 8 is a sectional side view of a secondary beam to main beam pin connection using a dowelling technique.
Figure 9:
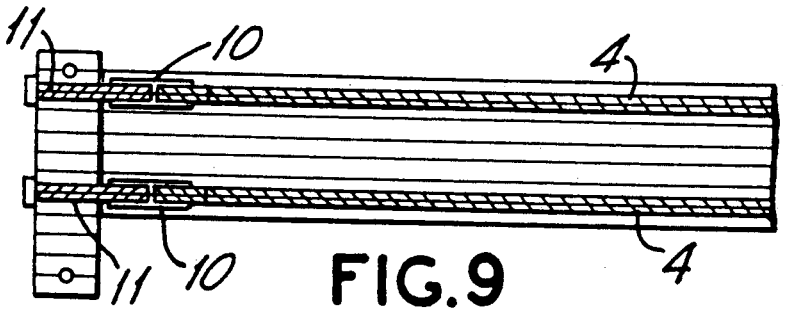
FIG. 9 is a sectional side view of a secondary beam to main beam moment connection using a mechanical anchoring technique.
Figure 10:
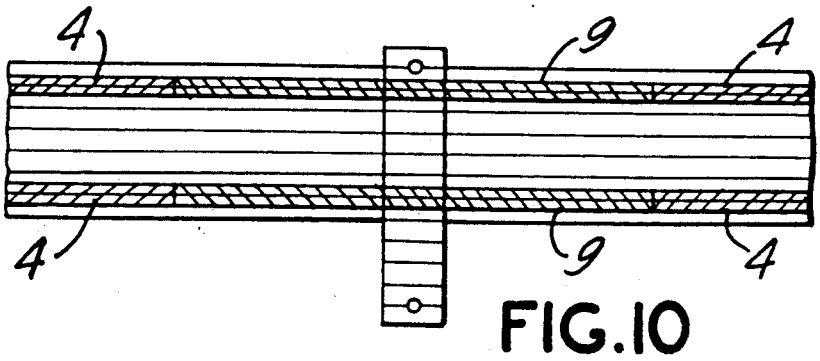
FIG. 10 is a sectional view of a continuous secondary beam to main beam pin connection using a dowelling technique.
Figure 11:
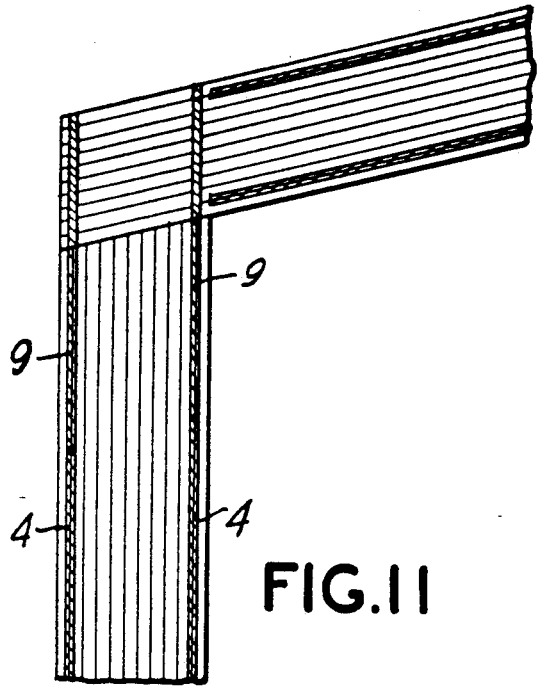
FIG. 11 is a sectional side view of a beam to column pin connection using a dowelling technique.
Figure 12:
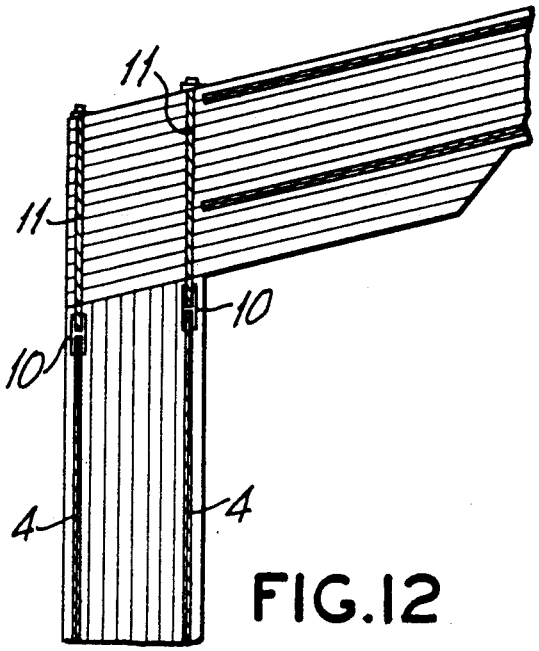
FIG. 12 is a sectional side view of a beam to column moment connection using a mechanical anchoring technique.
Figure 13:
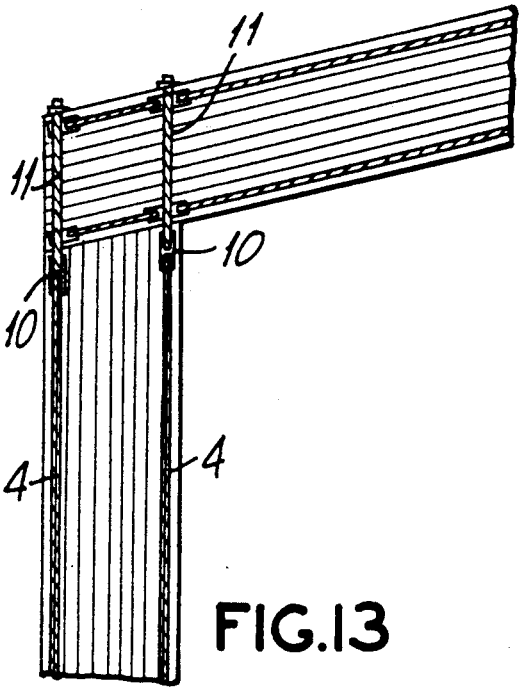
FIG. 13 is a sectional side view of a beam to column moment connection using an overlap technique.
Figure 14:
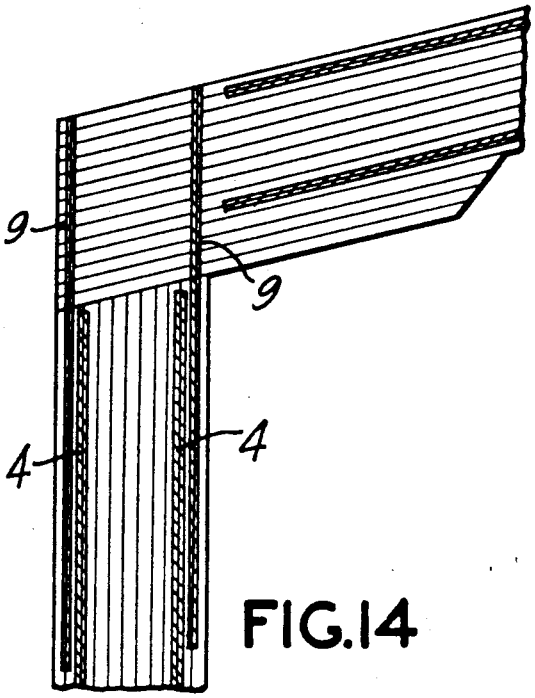
FIG. 14 is a sectional side view of a beam to column moment connection using a mechanical anchoring technique.
Figure 15:
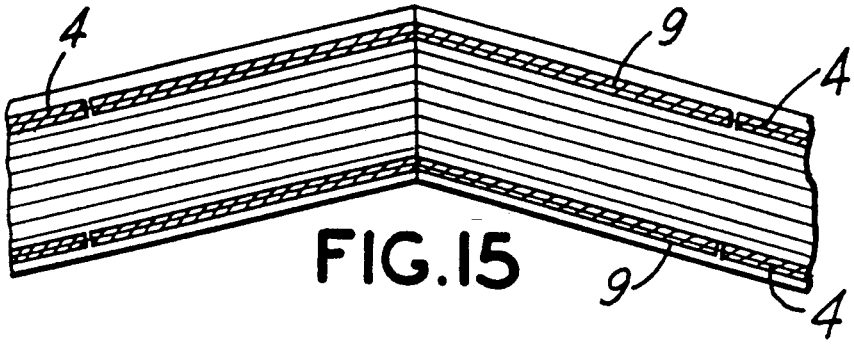
FIG. 15 is a sectional side view of a beam ridge pin connection using a dowelling technique.
Figure 16:
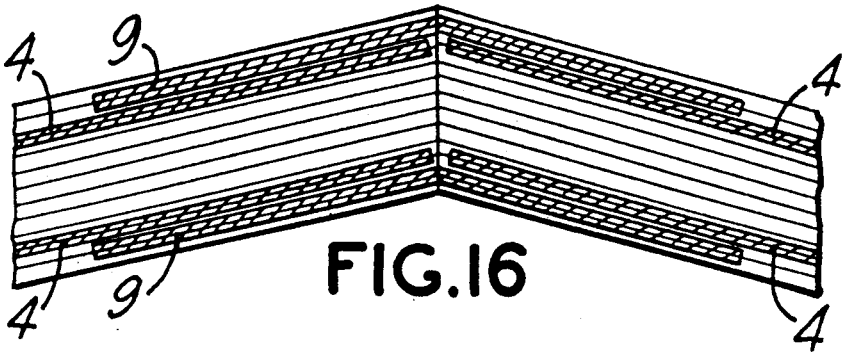
FIG. 16 is a sectional side view of a beam ridge moment connection using an overlap technique.
Figure 17:
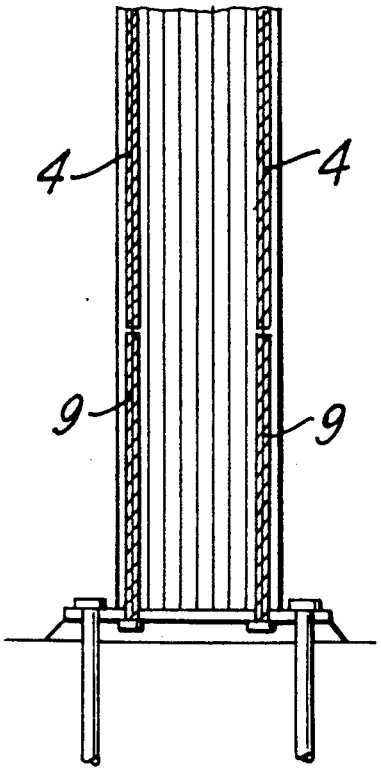
FIG. 17 is a sectional side view of a column footing pin connection using a dowelling technique.
Figure 18:
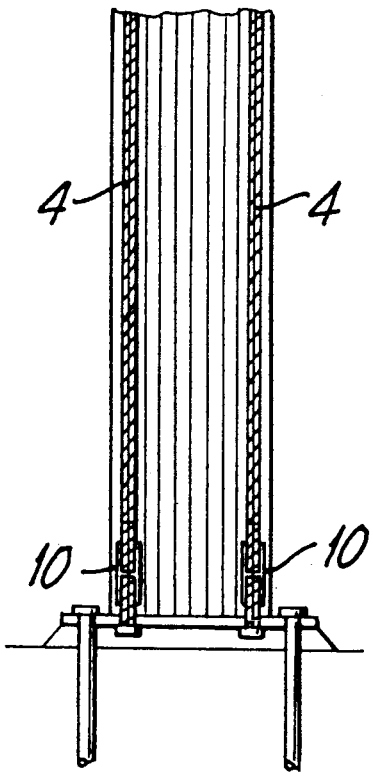
FIG. 18 is a sectional side view of a column footing moment connection using a mechanical anchoring technique.

FIG. 5 illustrates a laminated beam with reinforcing rods 4 extending approximately 90% of the length of the beam. Otherwise, the construction is substantially the same as illustrated in FIG. 1 and like reference numerals refer to like parts. This depicted arrangement lies within the most preferred range wherein the reinforcing rods extend 90% to 100% of the full length of the beam.

It has been calculated that an increase in the length of the reinforcing rod from 40% to 70% of the length of the beam may increase the stiffness of the beam from approximately 50% to 80%, while the increase in the length from 90% to 100% increases the stiffness by a further 5%. Maximum stiffness is thus obtained from the section extending the full length of the beam, and extensions over 90% are minimal.

FIGS. 6–18 illustrate embodiments according to the further aspect of the invention which relates to attachment of laminated structural timber elements to other structural members. The method of attachment may be achieved in the following preferred ways.

Figure 3:
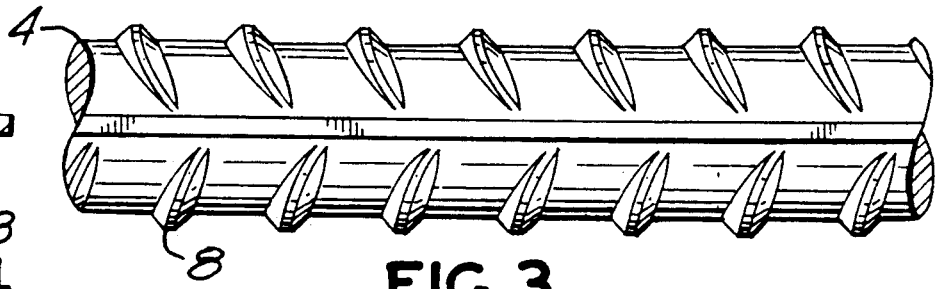
FIG. 3 is an enlarged side elevational view of a steel reinforcing rod.

The first method is a dowelling technique, making use of the empty grooves at the end of beams in which the reinforcing bars do not extend the full length of the beam, and inserting portions of reinforcing bars or sections 9, for connecting purposes into these grooves and butting them up against the in situ reinforcing bars or sections 4. The portions are fixed in place by injecting a resin-based adhesive, similar to that used in fixing the reinforcing sections in the beam, until the grooves are fully filled, see FIGS. 6, 8, 10, 11, 15 and 17. In these figures, like reference numerals to those of FIGS. 1–3, refer to like integers in those drawings.

The second preferred jointing method is an overlapping technique made by planing, milling, routing or drilling other grooves adjacent to the grooves in which the reinforcing sections are fixed, and inserting portions of reinforcing bars or sections 9 for connecting purposes, into these grooves. The portions overlap the in situ reinforcing bars or sections 4 sufficiently to transfer loads as dictated by Australian Standards Timber Engineering Code AS1720, and are fixed in place by injecting a resin-based adhesive, similar to that used in fixing the reinforcing sections in the beam, until the grooves are fully filled, see FIGS. 7, 13 and 16.

The third preferred method is a mechanical anchoring technique effected by using high strength steel reinforcing bars 4 and either threading the ends of the bars and using mechanical couplers or using mechanical splices 10; routing the groove around the ends of the bars to accommodate the larger outer diameter of a mechanical coupler or splice; placing the bar complete with the mechanical coupler or splice in the groove; and fixing the bars in place. Bolts or other threaded sections 11 can be screwed into the coupler or splice to make the joint, see FIGS. 9, 12, 14 and 18.

In the preferred method of manufacture, a groove is formed in the timber as the lamination passes through a moulder which dresses the lamination to the required thickness. The resin-based adhesive, in the case of the high strength deformed steel reinforcing bar, is placed in every groove as the lamination is passed through the glue spreader that applies the laminating glue to the dressed surfaces. The reinforcing section is placed in the beam as the beam laminations are assembled in a conventional manner. The structure is then cured to produce the desired reinforced laminated structural member.

Load tests conducted on a number of members constructed in accordance with the invention disclosed herein provide evidence of its value and effectiveness. The beams were tested using a two-point loading configuration, and tested in accordance with Australian Standards, Timber Engineering Code AS1720 as prototype tests and were therefore tested to the required equivalent test loads (ETL). The results of a typical test are tabulated in Table II together with theoretical values of both the unreinforced and reinforced beam. The member, whose results are shown in Table II, is a six meter long beam, 295 mm deep by 85 mm wide, of structural timber grade F8, Young's Modules of 9975 MPa, with 24 mm diameter high strength deformed steel reinforcing bars inserted between the outer top and bottom laminations with the bars' centers 35 mm from the outer faces of the beam. The bars extend the full length of the beam and are fixed in place with a resin-based adhesive, Epiglass Epiglue. The table shows that the theoretical and experimental values are similar, while the unreinforced and reinforced theoretical values highlight the 125% increase in strength and stiffness obtained by reinforcing the beam in the manner described.

TABLE II

| | DEFLECTION AT MID POINT OF BEAM (mm) | | |
|---|---|---|---|
| | REINFORCED BEAM | | |
| LOAD (TONNES) | EXPERI-MENTAL | THEORETICAL | UNREINFORCED THEORETICAL |
| 0 | 0 | 0 | 0 |
| 0.4 | 3.04 | 3.68 | 8.28 |
| 0.8 | 6.61 | 7.36 | 16.57 |
| 1.2 | 10.34 | 11.03 | 24.86 |
| 1.6 | 14.11 | 14.71 | 33.14 |
| 2.0 | 17.79 | 18.39 | 41.43 |
| 2.4 | 21.66 | 22.07 | 49.71 |
| 2.8 | 25.49 | 25.74 | 58.00 |
| 3.2 | 29.40 | 29.42 | 66.28 |
| 3.6 | 33.25 | 33.10 | 74.57 |
| 4.0 | 37.16 | 36.78 | 82.86 |
| 4.4 | 41.08 | 40.46 | 91.14 |
| 4.8 | 45.09 | 44.14 | 99.43 |

TABLE II-continued

| | DEFLECTION AT MID POINT OF BEAM (mm) | | |
|---|---|---|---|
| | REINFORCED BEAM | | |
| LOAD (TONNES) | EXPERI-MENTAL | THEORETICAL | UNREINFORCED THEORETICAL |
| 5.2 | 48.71 | 47.81 | 107.71 |
| 5.6 | 52.68 | 51.49 | 116.00 |

A number of beams were subjected to long term loads equal to their design loads to investigate timber relaxation. The results of timber relaxation tests for the beam described above are tabulated in Table III. The results show that there is a significant increase in the long term stiffness of laminated timber when reinforced in accordance with the invention disclosed herein. Whereas in natural timber a factor of 2.0 is applied to account for timber relaxation, the results of the tests on the reinforced laminated timber beams indicate that a factor very close to 1.0 can be used.

A number of beams have also been tested to failure. The tests show that with the application of loads which cause tensile cracks to occur on the tension face of the beams, the beams were still able to carry the applied load, proving that the invention as disclosed herein ensures against catastrophic collapse. The results of the test to failure of the beam described above are tabulated in Table IV, and shows the ability of the beam to carry the load after the splitting of the timber fibers on the tension face.

TABLE III

| TIME (HOURS) | DEFLECTION (mm) | INCREASE IN DEFLECTION (mm) |
|---|---|---|
| 0 | 25.55 | 0 |
| 25 | 25.75 | 0.20 |
| 50 | 25.75 | 0.20 |
| 125 | 25.75 | 0.20 |
| 325 | 25.85 | 0.30 |
| 375 | 25.90 | 0.35 |
| 500 | 25.90 | 0.35 |
| 550 | 25.95 | 0.40 |
| 675 | 25.80 | 0.25 |
| 725 | 25.80 | 0.25 |
| 900 | 25.90 | 0.35 |

TABLE IV

| LOAD (TONNES) | DEFLECTION (mm) | DESCRIPTION/REMARKS |
|---|---|---|
| 0 | 0 | |
| .815 | 9.75 | |
| 1.733 | 18.55 | |
| 2.752 | 27.50 | Design Load |
| 3.700 | 35.90 | |
| 4.587 | 44.00 | |
| 5.627 | 53.35 | Prototype ETL |
| 6.575 | 62.50 | |
| 7.492 | 71.45 | Tensile Cracks |
| 8.410 | 84.75 | |
| 9.378 | 101.10 | Ruptured Load |
| 5.060 | 143.80 | Load carrying capacity of ruptured section |

Whilst the above has been given by way of illustrative example of the invention, many modifications and variations may be made thereto by persons skilled in the art without departing from the broad scope and ambit of the invention as herein defined in the following claims.

What is claimed is:

1. A laminated structural timber member comprising a plurality of longitudinally extending wooden laminations bonded together by a resin adhesive and reinforced by at least two longitudinally extending solid metal rods, each rod having on an outer surface thereof an integral spiral winding projecting outwardly from said surface, said timber member being formed with grooves receiving said metal rods, said metal rods being each bonded to at least one lamination by said resin adhesive, one of said metal rods being bonded at a location between a longitudinal central axis of the timber member and one longitudinal edge of the timber member but extending within the timber member, and another of said metal rods being bonded at a location between the longitudinal central axis of the timber member and another longitudinal edge of the timber member but extending within the timber member, said spiral winding having a profile which enables a keying effect to be produced between the metal rods, said resin adhesive and said laminations to key the metal rod in place within the adhesive and the timber member without penetrating into the wooden laminations.

2. A laminated structural timber member as claimed in claim 1, and further including additional longitudinally extending solid metal rods each having an integral spiral winding projecting outwardly from the surface thereof, said additional metal rods being contained in grooves formed each in at least one lamination and being bonded to said lamination by said resin adhesive.

3. A laminated structural timber member as claimed in claim 1, wherein said grooves are positioned between adjacent laminations.

4. A laminated structural timber member as claimed in claim 3, wherein said two metal rods are positioned close to two opposite longitudinal edges of said timber member, respectively, and along a central axis thereof.

5. A laminated structural timber member as a claimed in claim 1, wherein said metal rods extend from 10% to 100% of the length of the timber member.

6. A laminated structural timber member as claimed in claim 1, wherein said metal rods extend from 70% to 100% of the length of the timber member.

7. A laminated structural timber member as claimed in claim 1, wherein the metal rods are located in the outermost laminations of the timber member.

8. A laminated structural timber member as claimed in claim 1, wherein said metal rods are steel reinforcing rods.

9. A laminated structural timber member as claimed in claim 1, wherein said timber member is a timber beam.

10. A laminated structural timber member as claimed in claim 9, which is adapted to enable attachment to other structural members.

11. A laminated structural timber member as claimed in claim 10, wherein additional grooves are formed in at least one of the beam to enable connecting rods to be inserted therein.

12. A laminated structural timber member as claimed in claim 10, wherein at least one end of at least one of the metal rods is routed around to enable attachment of bars to a mechanical coupler.

13. A laminated structural timber member comprising a plurality of longitudinally extending wooden laminations bonded together by a resin adhesive and reinforced by two longitudinally extending solid metal rods, each rod having on an outer surface thereof an integral spiral winding projecting outwardly from said surface, said timber member being formed with grooves receiving said metal rods, said metal rods being positioned along a transverse central axis of the timber member and being each bonded to at least one lamination by said resin adhesive, one of said metal rods being bonded at a location between a longitudinal central axis of the timber member and one longitudinal edge of the timber member but extending within the timber member, and another of said metal rods being bonded at a location between the longitudinal central axis of the timber member and another longitudinal edge of the timber member but extending within the timber member, said spiral winding having a profile which enables a keying effect to be produced between the metal rods, said resin adhesive and said laminations to key the metal rod in place within the adhesive and the timber member without penetrating into the wooden laminations.

14. A laminated structural timber member as claimed in claim 13, wherein a distance between each rod and a respective outer surface of the timber member is approximately equal to a distance between each rod and a respective side face of the timber member.

15. A laminated structural timber member as claimed in claim 13, and further including additional longitudinally extending solid metal rods each having an integral spiral winding projecting outwardly from the surface thereof, said additional metal rods being contained in grooves formed each in at least one lamination and being bonded to said lamination by said resin adhesive.

16. A laminated structural timber member as claimed in claim 13, wherein said grooves are positioned between adjacent laminations.

17. A laminated structural timber member as claimed in claim 13, wherein said metal rods extend from 10% to 100% of the length of the timber member.

18. A laminated structural timber member as claimed in claim 13, wherein said metal rods extend from 70% to 100% of the length of the timber member.

19. A laminated structural timber member as claimed in claim 13, wherein the metal rods are located in the outermost laminations of the timber member.

20. A laminated structural timber member as claimed in claim 13, wherein said metal rods are steel reinforcing rods.

21. A laminated structural timber member as claimed in claim 13, wherein said timber member is a timber beam.

22. A laminated structural timber member as claimed in claim 21, which is adapted to enable attachment to other structural members.

23. A laminated structural timber member as claimed in claim 22, wherein additional grooves are formed in at least one end of the beam to enable connecting rods to be inserted therein.

24. A laminated structural timber member as claimed in claim 22, wherein at least one end of at least one of the metal rods is routed around to enable attachment of bars to a mechanical coupler.

* * * * *